United States Patent [19]

Ebihara

[11] Patent Number: 4,527,092

[45] Date of Patent: Jul. 2, 1985

[54] MULTISTAGE SPENT PARTICLE COLLECTOR AND A METHOD FOR MAKING SAME

[75] Inventor: Ben T. Ebihara, Strongsville, Ohio

[73] Assignee: The United States of America as represented by the Administrator of the National Aeronautics and Space Administration, Washington, D.C.

[21] Appl. No.: 537,615

[22] Filed: Sep. 30, 1983

[51] Int. Cl.[3] ..... H01J 23/02; H01J 25/34; H01J 9/00

[52] U.S. Cl. ..... 315/5.38; 315/3.5; 445/35

[58] Field of Search ..... 315/5.38, 3.5; 313/41, 313/44, 106, 107, 256, 257, 258; 445/35, 46

[56] References Cited

U.S. PATENT DOCUMENTS

| | | | |
|---|---|---|---|
| 3,549,930 | 12/1970 | Katz | 313/44 |
| 3,644,778 | 2/1972 | Mihran | 315/5.38 |
| 3,662,212 | 5/1972 | Rawls | 315/3.5 |
| 3,925,701 | 12/1975 | Wolfram | 315/5.38 |
| 3,970,891 | 5/1976 | Heynisih | 315/3.5 |
| 4,277,721 | 7/1981 | Kosmahl | 315/5.38 |

*Primary Examiner*—David K. Moore
*Assistant Examiner*—William L. Oen
*Attorney, Agent, or Firm*—James A. Mackin; John R. Manning

[57] ABSTRACT

It is an object of the invention to provide a spent particle collector which will maintain its structural integrity when raised to a high temperature although constructed of materials having widely different coefficients of expansion. The collector is comprised of one or more axisymmetric stages, each stage comprising a subassembly. A subassembly includes an inner pyrolytic graphite ring, a transition ring, a ceramic insulator ring and an outer metal ring which forms part of the wall of the collector. Each transition ring is of a ductile metal having high thermal conductivity and is provided with an annular sputter shield wall extending toward the source of spent particles and, where necessary, a trough in the other surface to enclose the sputter shield of the next adjacent transition ring. A plurality of radial extending slots are provided in a transition ring to form segments which are retained in their position by the sputter shield. This arrangement with the ceramic ring outwardly of the transition ring keeps the latter in contact with the inner pyrolytic graphite ring.

17 Claims, 3 Drawing Figures

MULTISTAGE SPENT PARTICLE COLLECTOR AND A METHOD FOR MAKING SAME

ORIGIN OF THE INVENTION

The invention described herein was made by an employee of the U.S. Government and may be manufactured or used by or for the Government without the payment of any royalties thereon or therefor.

DESCRIPTION

1. Technical Field

This invention relates to collectors for spent electron beams and is directed more particularly to a multistage depressed collector constructed of subassemblies.

Pyrolytic graphite has been found to be a very good material from which to make the collector plates of multistage depressed collectors because undesirable secondary emission effects are substantially reduced. However, pyrolytic graphite has a much different coefficient of expansion than other metals and ceramics utilized in the construction of a collector. Thus, when the temperature of the collector changes due to variations in power of the electron beam, thermal stresses may damage the constituent materials at or near their interfaces.

2. Background Art

U.S. Pat. No. 4,277,721 to Kosmahl discloses a multistage depressed collector comprised of a plurality of axisymmetric electrode plates which are preferably of copper.

U.S. Pat. No. 3,549,930 to Katz shows a collector comprising an elongated carbon cup with a carbon diaphragm across its open end, the diaghragm having a central aperture through which spent electrons enter the cup. Alternating rings of pyrolytic graphite and metal are bonded to to outside surfce of the cup and to each other. These rings provide heat conductivity through the exterior of an electron tube to which the collector is attached.

U.S. Pat. No. 3,925,701 to Wolfram discloses an electron collector comprised of stacked alternating carbon and ceramic rings. Each carbon ring has an inner and an outer portion which are separated by a thin metallic ring.

DISCLOSURE OF THE INVENTION

In accordance with the invention, an electron collector is constructed by stacking one or more subassemblies, each subassembly forming a stage of the collector. Each subassembly includes an inner ring of pyrolytic graphite having a conical shape, a transition ring of a ductile metal having high heat conductivity, an electrically insulating ring of ceramic and an outer housing ring of metal. The joints between the rings are brazed individually or simultaneously after which final machining is performed on the outer ring, including the lap joint, and on the graphite. Treatment of the pyrolytic graphite surfaces, as for example by ion bombardment, may follow after the machining.

An annular band faces toward the electron source from each transition ring and serves as a sputter shield. Each cylindrical band is disposed in non-contacting, spaced-apart relationship within an annular trough in an adjacent transition ring. Each transition ring is separated into segments by radial grooves or slots, the segments being retained in position by the remaining material or by the cylindrical band.

The ceramic ring prevents radially outward expansion of the transition ring forcing it to expand radially inwardly toward the pyrolytic graphite ring. This prevents the joint between the transition ring and the pyrolytic graphite ring from opening up when heated. After the subassemblies are stacked, the lap joints in the outer rings are welded by electron beam welding, for example.

BEST MODE FOR CARRYING OUT THE INVENTION

Figure 1:
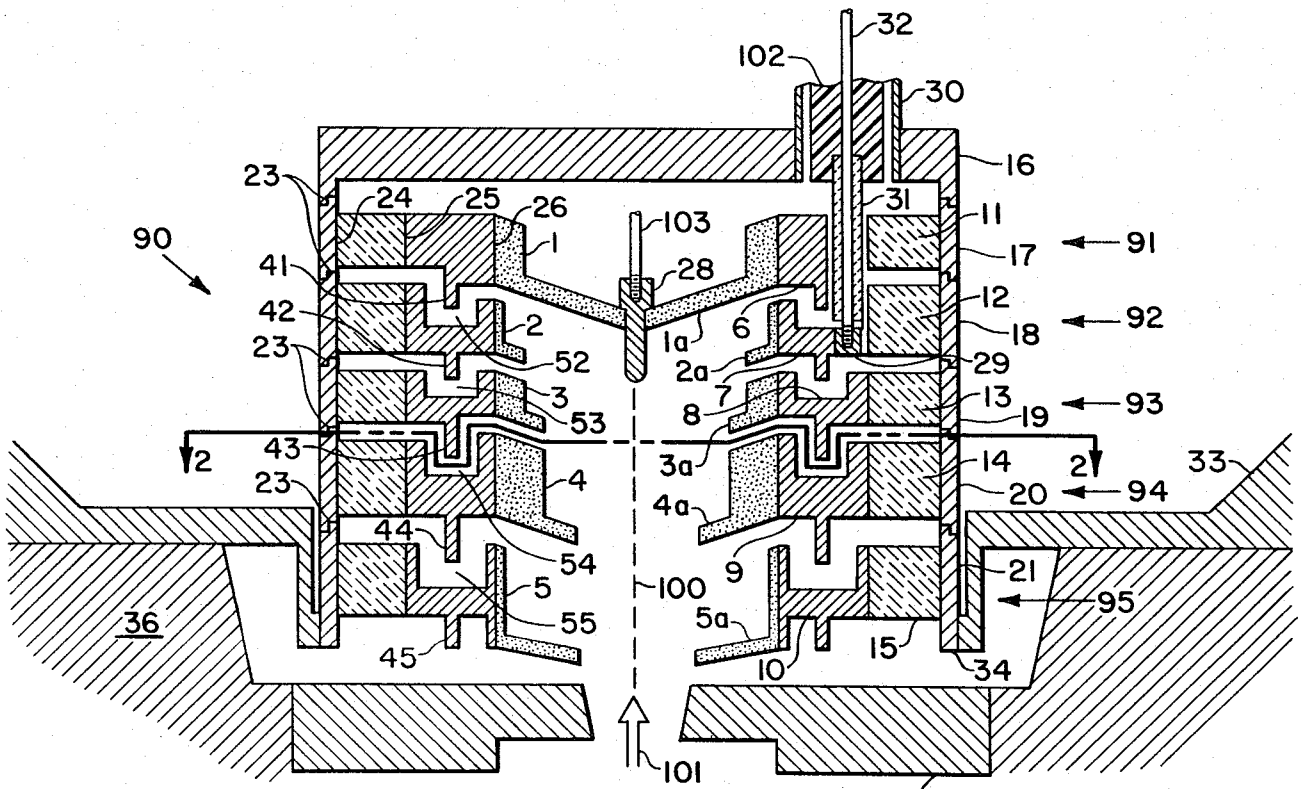
FIG. 1 is a longitudinal, axial section of an electron collector embodying the invention.

Referring now to FIG. 1, there is shown a collector 90 comprised, by way of example, of stages 91,92,93,94 and 95. Each of these stages, as will be discussed presently, is comprised of components forming a subassembly. The stages 91 through 95 include respective axisymmetric rings 1 through 5, these rings being pyrolytic graphite.

To capture spent electrons entering collector 90 in the direction of arrow 101, pyrolytic graphite rings 1 through 5 are provided with conical portions 1*a* through 5*a*, respectively. The conical portions, as shown, extend in an upstream direction toward the source of spent electrons. Each ring and its conical portion is an electrode plate.

Disposed outwardly of pyrolytic graphite rings 1,2,3,4 and 5 are respective ceramic rings 11,12,13,14 and 15 with the respective metal transition rings 6,7,8,9 and 10 interposed between and brazed to the pyrolytic graphite rings and the ceramic rings. The transition rings 6 through 10 are of a ductile metal such as copper, nickel or gold having high thermal conductivity and are preferably copper. The ceramic rings may be alumina for low power applications, but beryllia is preferred for high power applications where large amounts of heat must be transferred rapidly away from the pyrolytic graphite electrodes.

An outer wall of collector 90 is formed by low expansion metal rings 17,18,19, 20 and 21, the edges of which are provided with lap-type joints. Rings 17 through 21 are stacked in edge-to-edge relationship so that the lap joints of each ring engage those of adjacent rings. The rings 17 through 21 are in firm contact by brazing with the ceramic rings 11 through 15, respectively, so that heat may be transferred from the pyrolytic graphite electrodes 1, 1*a* through 5, 5*a* through the collector wall formed of the rings 17 through 21, and cooled by means of either air or a water jacket (not shown).

To support the collector 90, the ring 21 is attached to a flange 33 as at joint 34 which may be welded. Flange 33 is attached to the housing 36 of an electron utilizing device such as a traveling wave tube having an exit wall 35 for spent electrons traveling in the direction, as indicated by arrow 101.

The vacuum tight closure of collector 90 is completed by an end wall 16. End wall 16 has accommodation for electric connections to the transition rings 6 through 10. One such connection is illustrated by the lead 32 which is threaded into a metal insert 29 in transition ring 7. An insulator 102 and a ceramic sleeve 31 electrically isolate the lead 32 from a metal tube 30 in the wall 16.

It will be understood that similar connections must be provided for transition rings 8,9 and 10. Ring 6 may also have similar connection. But this type of connection is not provided for transition ring 6 because the desired electrical potential is applied to a metal spike 28 disposed in the pyrolytic graphite conical portion 1*a* and extending toward the source of spent electrons along the axis 100. The potential applied to spike 28 is accomplished by means of a lead 103. Lead 103 passes through end wall 16 by means of an insulator bushing and ceramic sleeve similar to 102 and 31, respectively.

As described above, each of the stages 91 through 95 is a subassembly comprised of an inner pyrolytic graphite electrode ring, a metal transition ring, a ceramic insulator ring, and an outer metal ring, the latter forming with the outer rings of the other stages, a cylindrical wall for the collector 90. Each subassembly comprising stages 91 through 95 is first assembled with the various rings positioned, as shown in FIG. 1. The joints between the various rings are individually or simultaneously brazed, the joints being typified as at 24,25 and 26 of stage 91. If the lap joints 23 of the outer rings 17 through 21 have not yet been provided, they may be machined into the outer rings at this time.

The rings 17 through 21 are next stacked as an assembly with the end plate 16 and accuracy of alignment checked. After satisfactory alignment has been achieved, the stages may be disassembled for the performance of other operations, such as ion bombardment of the surfaces of electrodes 1 through 5 and 1*a* through 5*a*.

For final assembly, the subassemblies of stages 91 through 95 and endplate 16 are assembled and the lap joints are welded as by electron beam welding. The metal outer ring 21 is also welded to the flange 33 as at 34.

Figure 2:
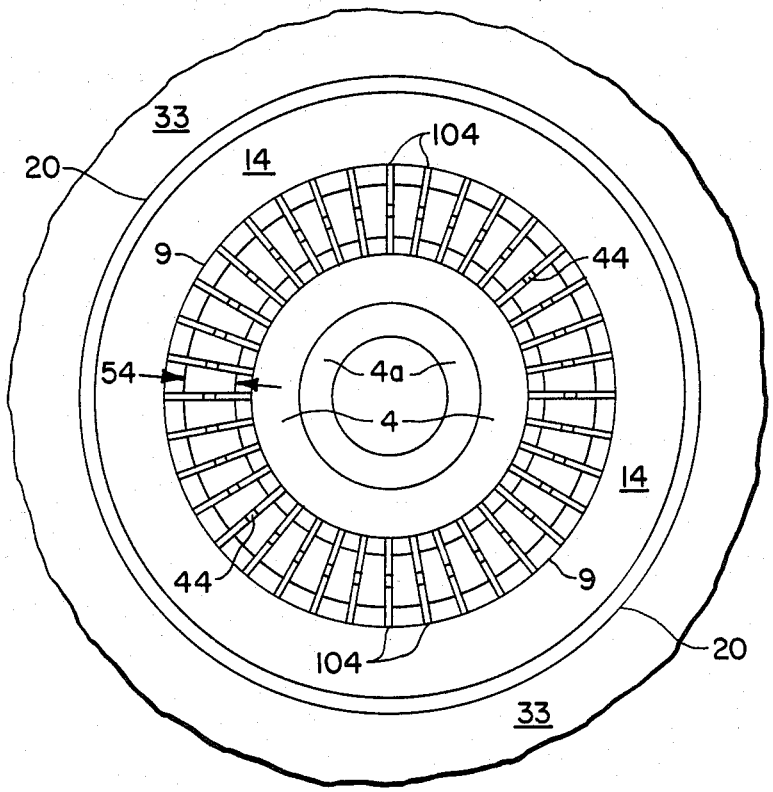
FIG. 2 is a transverse sectional view taken along the line 2—2 of FIG. 1.

FIG. 2 is a view taken along the line 2—2 of FIG. 1, and parts in FIG. 2 corresponding to those in FIG. 1 are identified by like numerals. As will be seen from FIG. 2, a metal transition ring 9 is divided into a plurality of arcuate segments by radially extending slots 104. The segments of transition ring 9 are retained in their relative positions by the cylindrical sputter shield band 44 which may be seen more clearly in FIGS. 1 and 3.

Figure 3:
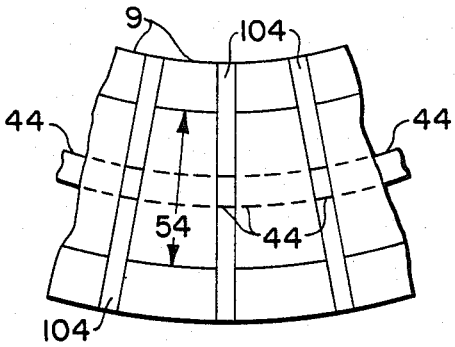
FIG. 3 is an enlarged view of a portion of FIG. 2.

FIG. 3 is a greatly enlarged view of one of the segments of transition ring 9 together with portions of adjacent segments. Sputter shield band 44 is shown by the solid lines in radial slots 104 and by the dashed lines in the segment of transition ring 9. The width of the trough in transition ring 9 is indicated by 54.

Because removal of heat from the pyrolytic rings 1 through 5 and portions 1*a* through 5*a* is very critical during operation of collector 90, it is important that heat transfer contact be maintained between the inner pyrolytic graphite rings 1–5, the transition rings 6–10, ceramic rings 11–5 and the outer metal rings 16–21 which make up the wall of the collector. Since the transition rings are of a high thermal conductivity metal such as copper which has a high coefficient of expansion, it would be expected that the joints between the pyrolytic graphite rings and the transition rings, as exemplified by 26, would separate or open up. This is avoided by segmenting the transition rings 6 through 10 by providing therein radially extending slots which, together with the action of the ceramic rings, prevents radial expansion of the transition rings.

The outer rings 17 through 21 and the end plate 16 are formed of a metal having a coefficient of expansion matching that of ceramic. Kovar metal has been found to be satisfactory with the collector embodying the invention. Other suitable metals include tantalum, molybdenum or tungsten/copper mixture which is about 20% by weight copper.

It will be understood that changes and modifications may be made to the above-described invention without departing from its spirit and scope as set forth in the claims appended hereto.

I claim:

1. A collector for spent, charged particles, said collector being attached to an exit wall of a charged particle source, said exit wall including an aperture through which spent charged particles are injected into the collector which comprises:

a metal cylindrical collector housing having an open end attached to said exit wall and also having a closed end;

at least one collector stage disposed axisymmetrically in said collector and comprising an inner collector ring of pyrolytic graphite, a transition ring of high conductivity, ductile metal and an outer ring of ceramic, the rings being in intimate contact with one another, with the outer ring being also in heat conducting contact with said collector housing;

said transition ring being divided into arcuate segments by a plurality of radially extending slots, and means for maintaining said arcuate segments in predetermined positions.

2. The collector of claim 1 including at least an entrance collector electrode and an end collector electrode, said entrance electrode being closer to said exit wall having a radially inwardly extending conical flange whose inner edge defines an aperture, said end collector electrode being closer to said closed end of said collector housing and having a transverse conical wall whose apex is directed toward said charge particle source.

3. The collector of claim 1 wherein said last named means is a cylindrical sputter shield band extending in a direction toward said source of spent, charged particles and shielding said ceramic ring from the deposition of electrically conductive materials.

4. The collector of claim 3 including at least an entrance electrode and an end electrode and wherein each transition ring except that of the end electrode includes an annular trough in its downstream side, the annular flange of each electrode extending into the annular trough of the next upstream adjacent transition ring in noncontacting spaced-apart relationship.

5. The collector of claim 1 wherein said high thermal conductivity, ductile metal is copper.

6. The collector of claim 1 wherein said ceramic outer ring is selected from the group of metals consisting of alumina and beryllia.

7. The collector of claim 1 wherein said collector housing is a metal having a coefficient of expansion approximately matching that of the ceramic used.

8. The collector of claim 1 wherein said cylindrical collector housing is comprised of at least one metal housing ring disposed outwardly of and in heat conducting contact with said ceramic ring.

9. The collector of claim 8 wherein the heat conducting contacts between said rings are brazed.

10. The collector of claim 8 wherein said at least one metal housing ring is provided with lap joints.

11. A method of making a collector for charged particles comprising the steps of:

forming a collector ring of pyrolytic graphite;

forming a transition ring of high thermal conductivity, ductile metal with a cylindrical sputter shield band and forming a plurality of radial slots in said transition ring;

Providing a ceramic insulating ring and a metal housing ring;

arranging the rings with the transition ring between the ceramic ring and the collector ring, the housing ring being radially outward of the ceramic ring, each ring making a heat conducting interface with any adjacent cooling ring;

brazing the interfaces thereby forming a subassembly stage;

forming lap joints in said metal housing ring;

providing a circular end plate with a peripheral lap joint;

mating the lap joint of the end plate with a lap joint of the subassembly and welding the mated lap joints, and welding the housing ring to a support flange.

12. The method of claim 11 wherein the depth of said slots is equal to the thickness of said transition ring, said axially extending cylindrical band retaining arcuate segments formed by said slots in predetermined positions.

13. The method of claim 11 wherein said transition ring is a metal selected from the group consisting of copper, gold and nickel.

14. The method of claim 11 wherein said ceramic ring is selected from the group consisting of alumina and beryllia.

15. The method of claim 11 wherein at least two collector subassemblies are provided.

16. The method of claim 11 wherein the interfaces between the graphite, ductile metal, ceramic and housing rings are brazed simultaneously.

17. The collector of claim 16 wherein said metal housing ring is selected from the group of metals consisting of tantalum, molybdenum, or a tungsten-20% by weight copper mixture.

* * * * *